US006125257A

United States Patent [19]

Sekine et al.

[11] Patent Number: 6,125,257

[45] **Date of Patent: *Sep. 26, 2000**

[54] METHODS AND SYSTEMS FOR CLEANING RESIDUAL TONER FROM IMAGE DEVELOPING DEVICE

[75] Inventors: Takeyoshi Sekine, Tokyo; Hiroshi Yamasita, Shizudka; Hiroyuki Fushimi, Touma; Makoto Ohsaki, Yokohama; Kouta Fujimdri, Minamimachi; Yasunori Kawaishi, Chiba; Jun Okamoto, Tokyo, all of Japan

[73] Assignee: Ricoh Co., Ltd., Tokyo, Japan

[ * ] Notice: This patent is subject to a terminal disclaimer.

[21] Appl. No.: 08/794,414

[22] Filed: Feb. 5, 1997

Related U.S. Application Data

[63] Continuation of application No. 08/585,630, Jan. 16, 1996, Pat. No. 5,648,842.

[30] Foreign Application Priority Data

Jan. 21, 1995 [JP] Japan ..... 7-026130

[51] Int. Cl.[7] ..... G03G 21/00

[52] U.S. Cl. ..... 399/343; 399/169; 399/350; 430/125

[58] Field of Search ..... 399/71, 343, 344, 399/349, 350, 160, 169; 430/125

[56] References Cited

U.S. PATENT DOCUMENTS

| | | | |
|---|---|---|---|
| 5,510,886 | 4/1996 | Sugimoto et al. | 399/308 |
| 5,521,691 | 5/1996 | Morimoto et al. | 399/350 |
| 5,648,842 | 7/1997 | Sekine et al. | 399/350 |

FOREIGN PATENT DOCUMENTS

| | | |
|---|---|---|
| 60-123860 | 7/1985 | Japan . |
| 60-123861 | 7/1985 | Japan . |
| 60-131547 | 7/1985 | Japan . |
| 6-17373 | 1/1986 | Japan . |
| 4-288554 | 10/1992 | Japan . |
| 5-27537 | 2/1993 | Japan . |

*Primary Examiner*—Sophia S. Chen
*Attorney, Agent, or Firm*—Knoble & Yoshida, LLC

[57] ABSTRACT

The current methods and systems for cleaning residual ultra-fine spherical toner from an image forming surface discloses the application of aspherical toner to a cleaning blade. The aspherical toner is generally larger than the ultra-fine spherical toner which provides a superior image on an image-carrying medium. According to one preferred embodiment of the current invention, the aspherical black toner is placed in a predetermined area outside of a desired image area where the ultra-fine spherical toner in multiple colors is placed. The aspherical toner is transported to the cleaning blade before the multi-color toner reaches the cleaning blade. Since the aspherical toner applied at a contacting edge of the cleaning blade provide an effective seal or trap between the cleaning blade and the image forming surface, the ultra-fine spherical toner is effectively removed from the image forming surface.

39 Claims, 15 Drawing Sheets

PRIOR. ART

METHODS AND SYSTEMS FOR CLEANING RESIDUAL TONER FROM IMAGE DEVELOPING DEVICE

This is a continuation application of application Ser. No. 08/585,630, filed Jan. 16, 1996 now U.S. Pat. No. 5,648,842.

FIELD OF THE INVENTION

The current invention is generally related to removal of toner from an image forming surface after the toner is transferred to an image-carrying medium and more particularly related to the methods and systems of effectively removing the residual ultra-fine spherical toner by pretreating a cleaning blade with irregularly shaped or aspherical toner in image forming devices such as photocopiers, printers, fax machines and the like.

BACKGROUND OF THE INVENTION

In the area of image reproduction, as the quality of reproduced images increases, the size of toner rendering the high quality images is generally reduced. Since high quality reproduced images usually appear more exact to the original, its reproduction process must reflect the exactness of minute details of the original images. At the above described high resolution, an image reproduction process requires significantly fine toner to faithfully reproduce original images in the exact manner. Because of the size, a larger number of the small toner particles is placed in a unit area than any large toner particles. The larger number of small toner particles allows the more exact rendition of minute details of the original.

In order to render a high quality reproduced image, the above described small toner is preferably spherical in its configuration. As toner is manufactured to reduce its size, the toner generally loses its mobility. The mobility allows toner to settle itself on an applied surface and forms a uniform layer. Because of the lack of this mobility, the irregularly shaped toner lumps together as it is applied on an image forming surface and prevents a smooth and uniform application in a desired area of the image forming surface. As the result of the non-uniform application, a reproduction process cannot yield a desired high resolution image. To preserve the above described mobility on the fine toner, Japanese Patent 6-17373 discloses a method of manufacturing ultra-fine spherical toner.

According to Japanese Patent 6-17373, the method of manufacturing spherical toner particles involves steps of dissolving 0.1–5% weight high polymer in a hydrophilic organic solution, and adding a single vinyl compound in less than 20 times the weight of the above high polymer. The vinyl dissolves in the hydrophilic organic solution, but the yielded vinyl-high polymer compound does not substantially dissolve in the hydrophilic organic solution. The above yielded toner compound averages its size in the range of 1 to 100 microns. In addition, the size distribution of the above yielded toner compound indicates that the above range with its ±25% variations amounts to approximately over 95% of the entire size spectrum. Other details regarding the dying procedures in the above described Japanese patent are hereby incorporated by the external reference and constitutes an inessential part of the current application.

The above described mobile ultra-fine spherical toner generally helps reproduce high resolution images but contributes to a difficulty in removing residual toner from the image forming surface during a cleaning procedure. To appreciates the above mentioned difficulty in the cleaning procedure, referring to FIG. 1, a photocopying process is generally described. To photocopy an original image on an image-carrying medium 60, a scanned original image is developed on an image forming surface of a photoreceptor drum 20. To develop the image, a charger 30 forms an uniform layer of electrical charges on the image forming surface 20 prior to a selective removal by exposing a predetermined light according to the scanned original image. The electrically represented original image on the photoreceptor drum 20 is then developed by applying toner contained in a developer 40. Because of the electrical charge, the applied toner is selectively adhering to the photoreceptor drum 20 and is finally transferred to an image-carrying medium 60 via a transfer charger 70. Since the above applied toner is not completely transferred to an image-carrying medium 60, some toner remains on the photoreceptor drum 20. The residual toner must be removed before the next photocopying process so that the residual toner does not undesirably interfere the next reproduction process.

To remove the above described residual toner from the photoreceptor drum 20, a cleaning unit 26 performs a cleaning procedure. Still referring to FIG. 1, the cleaning unit 26 is located near the photoreceptor drum 20 as well as the transfer charger 70 and generally includes a cleaning blade 24 and a cleaning brush 25. After the toner representing an original image is transferred to an image-carrying medium 60, a portion of the toner remaining on the image forming surface is transported towards the cleaning unit 26 as the photoreceptor drum 20 is rotated in a clockwise direction as indicated by an arrow. When the residual toner approaches the cleaning unit 26, the cleaning brush 25 initially removes a certain portion of the residual toner off the photoreceptor drum 20. The removed toner is collected in the cleaning unit housing. However, some portion of the residual toner still remains on the photoreceptor drum 20 and is removed by the cleaning blade 24 as the photoreceptor drum 20 is further rotated. The cleaning blade 24 is generally made of flexible rubber and is positioned so that at least its edge portion is pressed against the rotating photoreceptor drum 20 at a predetermined oblique angle. Because of the above described press fit contact, the residual toner is further removed from the photoreceptor drum surface 20. The removed toner is collected in the cleaning unit housing 26 and is transported by a collection coil 28 for the recycling use. With the use of large conventional toner particles, the above described brush and cleaning blade remove substantially all the residual toner particles and the photoreceptor drum 20 is able to reproduce another image without any interference from the residual toner.

In contrast to the above described effectiveness of the cleaning process against the removal of the conventionally sized toner particles, the conventional cleaning process cannot effectively remove the ultra-fine spherical toner to the same extent. In other words, when the ultra-fine spherical toner is used in the photocopying device as described with respect to FIG. 1, repeated image production outputs undesirable images, for example, with streaks of lines caused by the unremoved residual ultra-fine spherical toner. The reasons for failing to remove the undesirable residual toner are hypothesized, and one of the hypotheses is described in FIGS. 2A–2C.

Referring to FIGS. 2A–2C, the above described undesirable residual toner is not removed by a cleaning blade 24. FIG. 2A diagrammatically illustrates a cross-sectional view of a residual portion of ultra-fine spherical toner 22 remaining on a photoreceptor drum 20 and approaching a cleaning blade 24. When the spherical toner 22 contacts the cleaning blade 24, it rotates on the surface of the photoreceptor drum 20 so as to push the cleaning blade 24 away from the image forming surface for creating a gap. As the photoreceptor drum 20 further rotates as indicated by an arrow, the spherical toner 22 also further rotates and escapes through the gap to the other side of the cleaning blade 24 as shown in FIG. 2C. Thus, the cleaning blade 24 fails to remove the residual spherical toner 22 from the photoreceptor drum 20. In the alternative, although not shown in the above referenced figures, the ultra-fine toner also escapes the cleaning blade pick-up through a gap that exists without the above described push-up motion by the spherical toner. Since either the blade edge or the image forming surface is not perfectly smooth, there exist minute gaps between the blade edge and the image forming surface. In fact, the smaller the toner, the more easily it escapes through the above described minute gaps. Consequently, regardless of the blade failure to remove the ultra-fine toner, the undesirably remaining spherical toner will be interfering with the next image production process. Although the conventional photocopying device can potentially improve certain image qualities with the use of the ultra-fine spherical toner, even the normal use of the photocopying device cannot take advantages of the above described favorable features of the ultra-fine spherical toner. To capitalize the advantageous features of the ultra-fine spherical toner, the prior attempts involve various approaches. For example, Japanese Patents 60-123860, 60-123861 and Japanese Patent Open-Laid Publication 60-131547 disclose one approach in which the above described ultra-fine spherical toner is mixed with larger irregularly shaped toner prior to the application onto an image forming surface. Although the cleaning efficiency of a conventional cleaning unit has increased due to the larger irregularly shaped toner, as intuitively clear, the reproduced image quality by the mixed toner has degraded also by the irregularly shaped large toner. Another approach, for example, disclosed by Japanese Patent 4-288554 involves the application of a cleaning enhancing agent onto the residual toner remaining on the photoreceptor drum prior to the blade cleaning. The cleaning enhancing agent includes non-toner particles of 10–30 microns with approximately 0.05–2 weight % of mobility enhancer. To apply the cleaning enhancing agent, an additional container as well as an associated controller for regulating the application of the cleaning enhancer are required. In addition to the additionally required hardware, this approach is also cost prohibitive due to the additional supply of the cleaning enhancing agent. The above described prior attempts cannot fully capitalize the advantages of the ultra-fine spherical toner without additional costs and are desired to be improved.

SUMMARY OF THE INVENTION

To solve the above and other problems, according to one preferred embodiment of the current invention is a method of cleaning toner on a surface of an image forming device after development by a cleaning blade, the toner including first toner and second toner, includes the following steps of: a) developing an image according to the toner including at least the first toner placed on a first area of a surface of the image forming device; b) transferring the toner in the first area to an image carrying medium; c) placing the second toner on the cleaning blade which contacts the surface of the image forming device; and d) removing the first toner remained on the surface after the step b) by the cleaning blade treated with the second toner in the step c), wherein the second toner provides a substantially effective seal between the surface of the image forming device and the cleaning blade so as to facilitate the first toner to depart from the surface of the image forming device.

According to a second aspect of the current invention, a method of cleaning toner on a surface of an image forming device after development by a cleaning blade, the toner having first toner and second toner, includes the following steps of: a) placing the first toner according to a desired image in a first area on the surface of the image forming device, the first toner being substantially spherical; b) placing the second toner in a second area outside of the first area on the surface of the image forming device, the second toner being substantially aspherical; c) transferring a substantial portion of the first toner in the first area to an image carrying medium and leaving a residual portion of the first toner on the surface; d) transporting the second toner to the cleaning blade before the residual portion of the first toner reaches the cleaning blade; e) preventing the residual portion of the first toner from rotating on the cleaning blade which contacts the surface of the image forming device; and f) removing the residual portion of the first toner from the surface by the cleaning blade treated with the second toner, wherein the second toner provides a substantially effective seal between the surface of the image forming device and the cleaning blade so as to facilitate the first toner to depart from the surface of the image forming device.

According to a third aspect of the current invention, a system for cleaning residual toner, includes: a first container for containing first toner; a second container for containing second toner; an image forming surface located near the first container and the second container for developing a desired image according to at least the first toner placed on the image forming surface; a cleaning blade selectively in contact with the image forming surface for removing the first toner from the image forming surface, the image forming surface and the cleaning blade in contact having a minute gap through which the first toner passes; and a cleaning enhancer for applying the second toner to the cleaning blade so as to substantially facilitate a removal of the first toner from the image forming surface, wherein the second toner substantially seals the minute gap between the image forming surface and the cleaning blade so that the cleaning blade more effectively removes the first toner from the image forming surface.

According to a fourth aspect of the current invention, a system for cleaning residual toner, includes the following components: a first container for containing substantially spherical toner defining first toner; a second container for containing substantially aspherical toner defining second toner, the second toner being larger than the first toner; an image forming surface located near the first container and the second container for developing an image according to at least the first toner placed on the image forming surface; a cleaning blade selectively in contact with the image forming surface for removing the first toner from the image forming surface, the image forming surface and the cleaning blade in contact still having a minute gap through which the first toner passes; and a second toner applicator for applying the second toner to the cleaning blade so as to facilitate a removal of the first toner from the image forming surface, the second toner provides a substantially effective seal for the gap between the image forming surface and the cleaning blade so as to prevent the first toner from passing through the gap.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 3A:
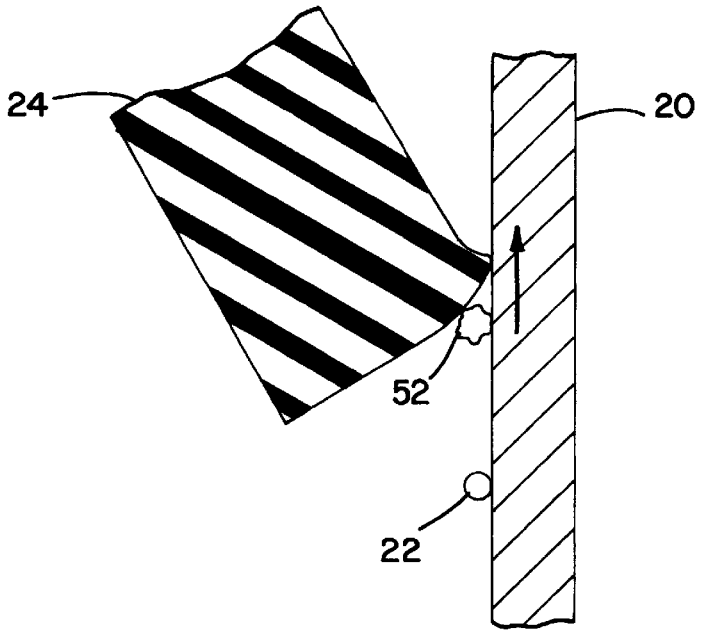
FIGS. 3A, 3B and 3C diagrammatically illustrate close up views as to how one preferred embodiment of the current invention effectively removes spherical toner from an image forming surface with aspherical toner via a cleaning blade.

Referring now to the drawings, wherein like reference numerals designate corresponding structure throughout the views, and referring in particular to FIG. 3A, according to one preferred method of the current invention, one step involves the application of large irregularly shaped or aspherical toner 52 to an edge of a cleaning blade 24 prior to the arrival of a residual portion of ultra-fine spherical toner 22 remaining on an image forming surface 20 after a transferring process. According to this preferred method, the above described application of the aspherical toner 52 is accomplished by placing the aspherical toner 52 at a predetermined location of the image forming surface 20 so that the aspherical toner necessarily arrives at the cleaning blade 24 before the spherical toner 22. The application is not limited to the above described step according to the current invention. The above aspherical toner 52 are generally larger than approximately 7 microns in diameter while the spherical toner 22 is preferably smaller than approximately 7 microns in diameter.

As described in the Background section of the current application, the ultra-fine spherical toner is manufactured according to the disclosure of Japanese Patent 6-17373 incorporated herein by external reference as an inessential material. For the manufacture of the above aspherical toner 52 involves steps of mixing carbon black (5% weight of polyester resin) and salicylic acid derivative zincate as an antistatic agent with polyester resin for approximately 30 minutes at 100° C., after grinding the above compound by a jet stream grinder, separating approximately 7.5 micron particles by a turbo classifier; and finally mixing 1% weight hydrophobic fine silica powder by a mixer.

Figure 3B:
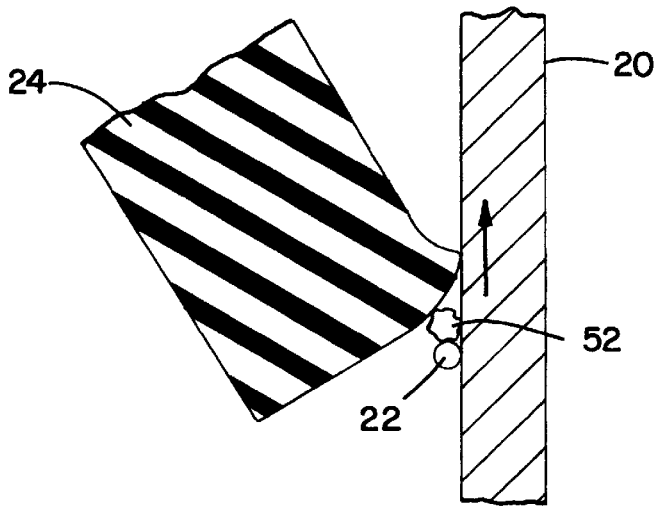
Figure 3C:
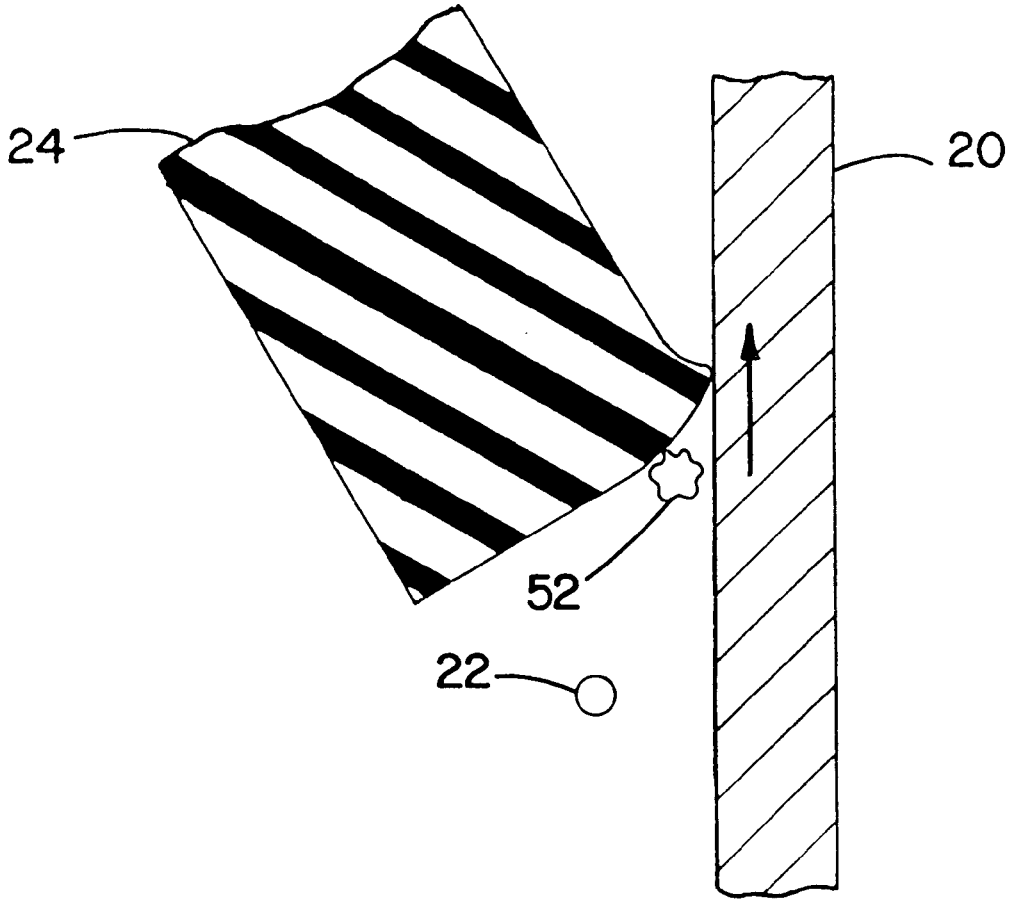

Still referring to FIG. 3A, as the image forming surface 20 transports the aspherical toner 52, a cleaning blade 24 engages the aspherical toner 52 and traps it along an edge. Unlike the ultra-fine spherical toner, because of the larger size and irregular shape, the aspherical toner 52 remains on the same side of the cleaning blade 24 between the cleaning blade 24 and the image forming surface 20 even though the edge of the blade 24 may be flexibly repositioned as shown in FIG. 3A. As the image forming surface is further rotated in the same direction as indicated by an arrow, the spherical toner 22 is transported towards the trapped aspherical toner 52 at the edge of cleaning blade 24. Now referring to FIG. 3B, the on-coming ultra-fine spherical toner arrives at the cleaning blade 24 and collides with the trapped aspherical toner 52. As the spherical toner 22 contacts the aspherical toner 52, the aspherical toner provides a substantially effective seal between the flexible rubber cleaning blade edge and the image forming surface to prevent the passage of the collided ultra-fine toner 22. Even though the spherical toner 22 rotates on the surface of the image forming surface 20, the effectively sealing aspherical toner 52 substantially facilitates the departure of the spherical toner from the moving image forming surface 20. Consequently, as shown in FIG. 3C, the cleaning blade 24 substantially removes both the aspherical and spherical toner 52 and 22 from the image forming surface so as not to cause any interference with a next cycle of the image reproduction process.

Figure 1:
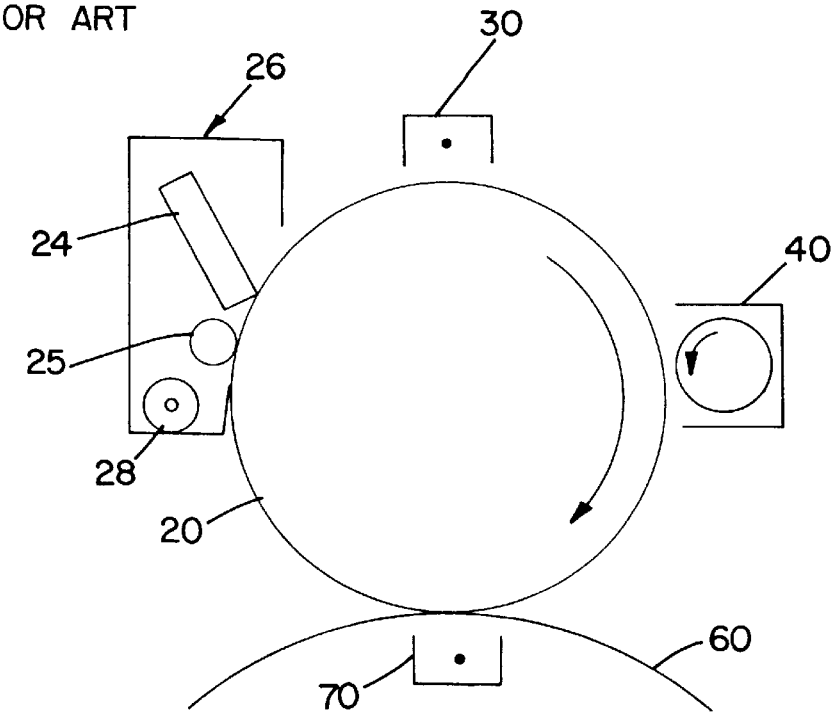
FIG. 1 PRIOR ART
FIG. 1 illustrates how a cleaning blade fails to remove spherical toner from an image forming surface.
Figure 2A:
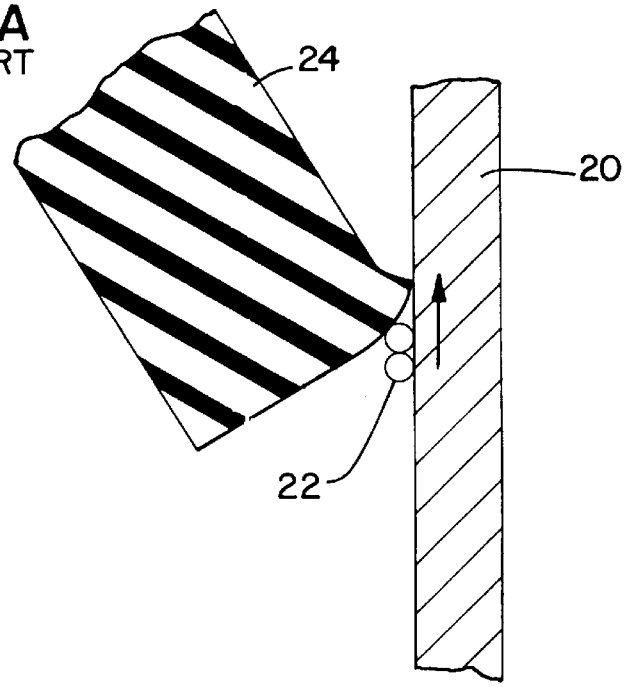
FIG. 2A PRIOR ART
FIGS. 2A, 2B and 2C diagrammatically illustrate prior art photocopier components with one toner container.
Figure 2B:
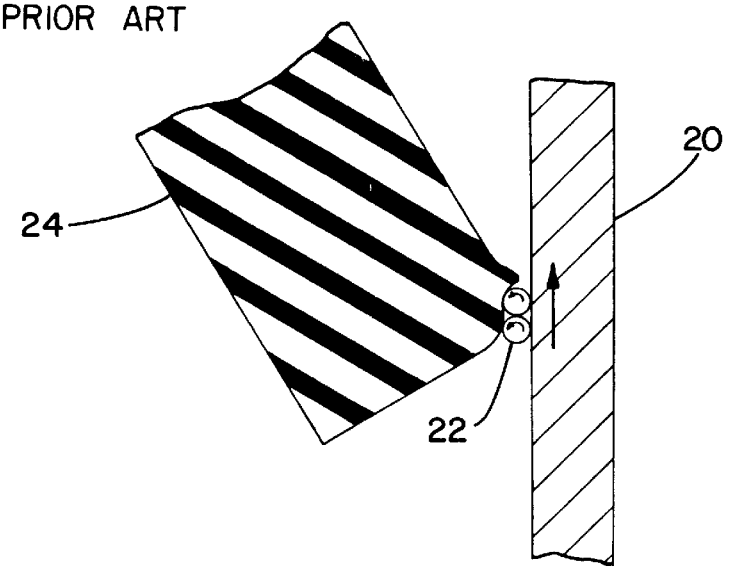
FIG. 2B PRIOR ART
Figure 2C:
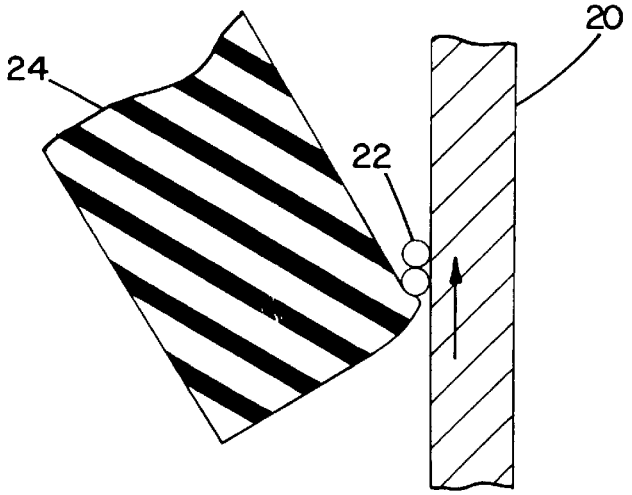
Figure 4:
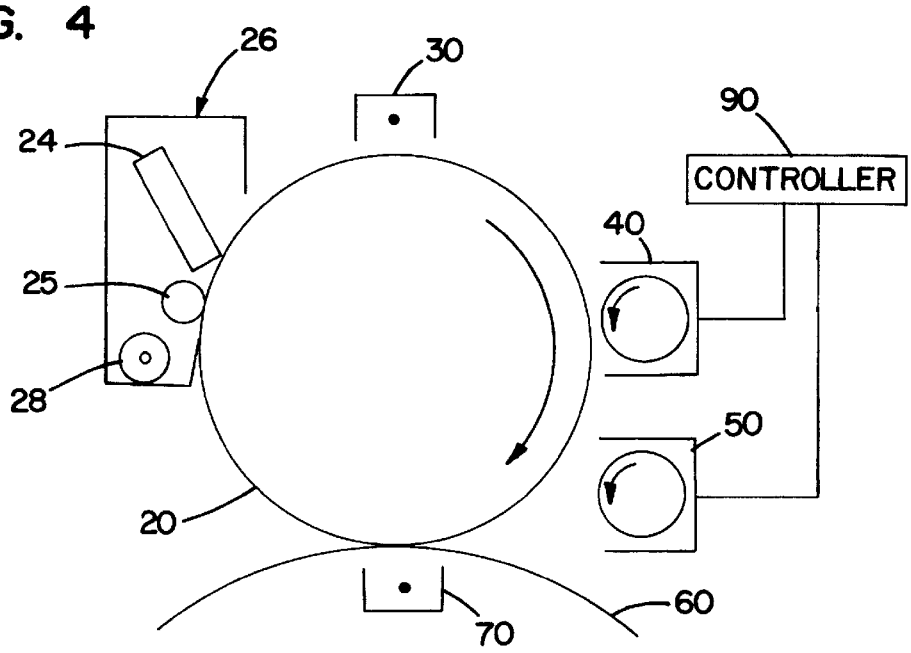
FIG. 4 diagrammatically illustrates photocopier components according to the current invention with two toner containers respectively containing spherical and aspherical toner.

To apply aspherical toner in the above described step, according to the current invention, one preferred embodiment of a photocopying device is shown in FIG. 4. As already described with respect to FIG. 1, the most components are identical except for a second developer 50 located adjacent to the first developer 40 as well as a controller 90. The controller 90 generates a signal upon determining the aspherical toner application. In response to the above signal, the second developer 50 applies the above described aspherical toner to the image forming surface before the first developer 40 applies the spherical toner so that the aspherical toner first arrives at the cleaning blade by the virtue of the location with respect to the cleaning blade. In addition, these two toner may or may not be in the identical color. If the same color for example black is used for the two toner, as described above, a desired image is developed by the ultra-fine spherical toner while the aspherical toner does not have to be a part of the desired image. If, on the other hand, two colors are used for image reproduction, the aspherical toner may be selected for a less frequently used color of the two such as black. Even though this two color arrangement does not necessarily guarantee the arrival of the aspherical toner prior to the spherical toner, one can take a significant advantage of the high resolution of the spherical toner while effectively increasing the residual ultra-fine toner cleaning by the large toner. In either of the above described two toner arrangement, the aspherical toner is also optionally applied outside of an desired image area.

Figure 5:
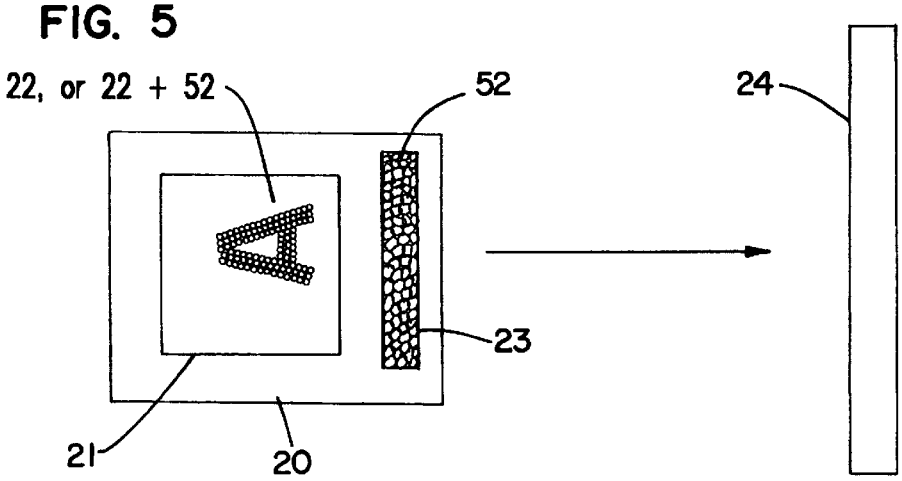
FIG. 5 diagrammatically illustrates a positional relation between spherical toner for generating a desired image and aspherical toner outside the desired image closer to a cleaning blade with respect to a moving direction of an image forming surface towards a cleaning blade.

Referring to FIG. 5, relative locations of the spherical and aspherical toner are diagrammatically shown with respect to the cleaning blade location. On an image forming surface 20, a first area 21 is designated to develop a desired image using either spherical toner 22 or a combination of both spherical and aspherical toner 22, 52. On the other hand, a second area 23 is located outside of the first area and closer to a cleaning blade 24 with respect to the moving direction towards the cleaning blade 24. The second area 23 is designated to the aspherical toner 52 only. According to one preferred method, the second area 23 is a strip extending in a direction perpendicular to the above described moving direction of the image forming surface 20, and the strip is at least as wide as the first area 21. The above described relative location of the aspherical toner deposit guarantees to provide a substantially effective seal for the removal of the residual spherical toner via the cleaning blade.

Figure 6:
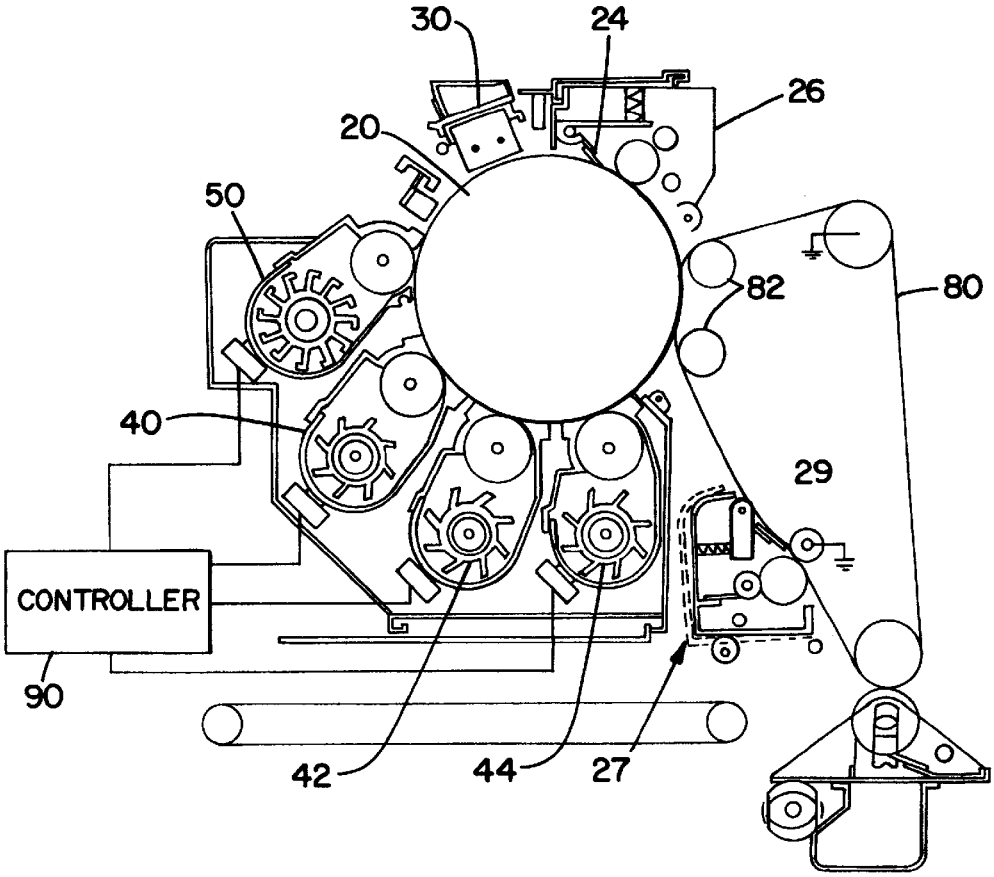
FIG. 6 diagrammatically illustrates a second preferred embodiment of the photocopier components according to the current invention which include multiple toner containers located around an image forming surface and respectively containing spherical color toner and aspherical black toner.

Now referring to FIG. 6, according to another aspect of the current invention, a second preferred embodiment of the photocopying system is illustrated for the image reproduction in full color. Generally, the full color reproduction system is the same as the system shown in FIG. 4 except for two extra developers 42, 44 for additional colors as well as an intermediate transfer belt 80 with associated components. In this system, a desired developed image on a photoreceptor drum 20 is initially transferred onto the intermediate transfer belt 80 located near the photoreceptor drum 20. The transferred toner image on the intermediate belt 80 is subsequently transferred onto a final image-carrying medium. For the purposes of this invention, the intermediate transfer belt 80 is also considered as an intermediate image-carrying medium. The residual toner on the photoreceptor drum 20 is removed by a cleaning unit 26 as already described with respect to FIG. 4. In addition to the above residual toner cleaning, residual toner must be also removed from the intermediate transfer belt 80 after a certain portion is transferred onto a final image-carrying medium. For the intermediate belt residual toner cleaning, a second cleaning unit 27 is provided near the intermediate transfer belt 80. The second cleaning unit 27 is essentially identical to the above described first cleaning unit 26.

Still referring to FIG. 6, according to a second aspect of the current invention, the above described ultra-fine spherical toner is used for most frequently used colors such as cyan, magenta and yellow while the above described aspherical large toner is used for the least frequently used black color. The developers 40, 42 and 44 respectively contain the above described frequently used ultra-fine color toner, and the developer 50 contains the black aspherical toner for substantially enhancing the removal of the residual ultra-fine aspherical toner after each of the two transfer processes. Since the black color is the least frequently used in normal full color image reproduction, the use of black toner least affects the quality of image reproduction. As described above, in response to a controller 90, a black aspherical toner is applied to a photoreceptor drum surface 20 at a position that guarantees the delivery of the aspherical black toner to a cleaning blade 24 prior to the ultra-fine color spherical toner so as to provides a substantially effective seal between the flexible rubber cleaning blade edge and the image forming surface to prevent the passage of the spherical ultra-fine toner. One such position is diagrammatically shown in FIG. 5. This guaranteed position also must secure the delivery of the same aspherical toner to a second cleaning blade 29 prior to the residual ultra-fine spherical toner on the intermediate transfer belt 80.

Still referring to FIG. 6, to ascertain the prior delivery of the aspherical toner to both cleaning blades 24, 29, a controller 90 coordinates the sequence of the transfer for each color as well as the cleaning procedure. After one color toner is transferred onto the photoreceptor drum 20, the same color toner is transferred onto the intermediate belt. After each transfer, the photoreceptor drum 20 undergoes the above described cleaning procedure for removing the residual spherical toner. On the other hand, the intermediate transfer belt simultaneously holds all of the above described multiple color toner for a full color image. After the full color image is transferred onto a final image-carrying medium, the intermediate transfer belt 80 undergoes the cleaning procedure for all of the multi-color residual toner. The controller 90 selectively places the second cleaning unit 27 at a predetermined activated position at a predetermined time only after the full color image is transferred onto a final image-carrying medium. At the predetermined activated position, a second cleaning blade 29 is in contact with the intermediate transfer belt 80 at a predetermined angle for removing the residual toner on the intermediate transfer belt. At the end of the above described residual toner cleaning, the controller 90 repositions the second cleaning unit 27 at a predetermined deactivated position.

At the activated position, the second cleaning blade 29 functions essentially the same way as the first cleaning blade 24. To remove substantially all of the residual ultra-fine toner on the intermediate transfer belt 80, the larger irregularly shaped toner must be applied to an edge of the second cleaning blade 29 so as to provide a substantially effective seal between the flexible rubber cleaning blade edge and the image forming surface to prevent the passage of the spherical ultra-fine toner. In addition to the preserved original relative location of the aspherical toner for arriving at the second cleaning blade 29 before the ultra-fine spherical toner, the controller 90 optionally activates the transfer bias rollers 82 in such a way to selectively regulate the transfer of the applied toner from the photoreceptor drum 20 to the intermediate transfer belt 80 to ascertain the above described prior delivery of the aspherical toner to the second cleaning blade 29. As is the case with the photoreceptor drum 20, the intermediate transfer belt 80 must be substantially cleaned so as to prevent any interference with the next cycle of image transfer.

Figure 7:
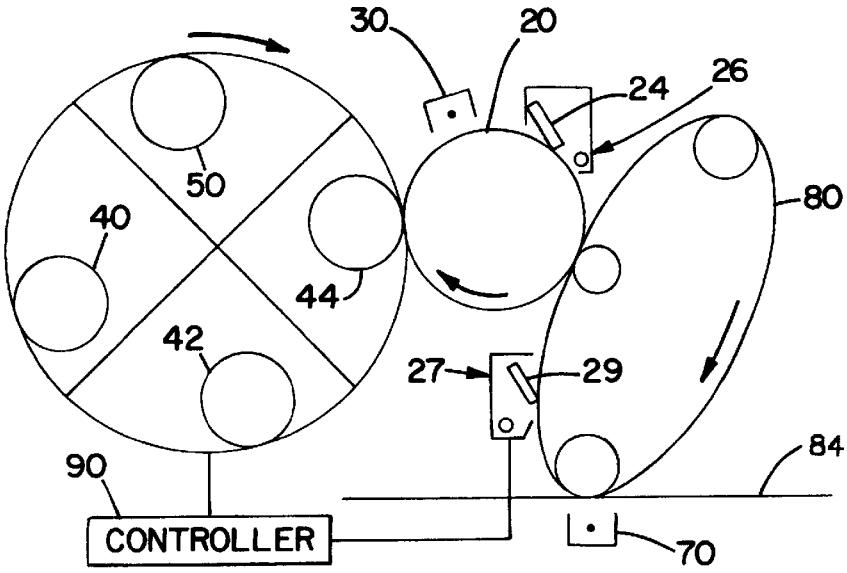
FIG. 7 diagrammatically illustrates a third preferred embodiment of the photocopier components according to the current invention which include a rotary developing device that houses toner containers for respectively containing spherical color toner and aspherical black toner.

Referring to FIG. 7, according to yet another aspect of the current invention, a third preferred embodiment of the photocopying system is illustrated for the full color image reproduction. In general, this full color reproduction system is the same as the system shown in FIG. 6 except that the developing units 40, 42, 44 and 50 are housed in a rotary developing housing. A controller 90 selects one of these developing units to be juxtaposed to an image forming surface of the photoreceptor drum 20 for applying desired toner. Then, the toner is transferred to an intermediate transfer belt 80 before the next toner is applied. The intermediate transfer belt 80 holds a full color image and then transfers it onto a final image-carrying medium 84. As discussed before, a first cleaning unit 26 removes a residual portion of aspherical toner from the photoreceptor drum 20 after each color toner is applied. In contrast, a second cleaning unit 27 removes residual multi-color spherical toner after a full color image is transferred onto a final image-carrying medium. For this reason, the second cleaning unit 27 is selectively activated by the controller 90.

Still referring to FIG. 7, as discussed above with respect to FIG. 6, the aspherical toner applied to an edge of the cleaning blades 24 and 29 provides a substantially effective seal between the flexible rubber cleaning blade edge and the image forming surface to prevent the passage of the ultra-fine spherical toner. Even though the spherical toner rotates on the surface of the image forming surface 20 as it collides with the cleaning blade, the effectively sealing aspherical toner substantially facilitates the departure of the residual spherical toner from the moving image forming surface. Consequently, the cleaning blades 24 and 29 substantially remove both the aspherical and spherical toner from the image forming surface so as not to cause any interference with a next cycle of the image reproduction process.

Figure 8:
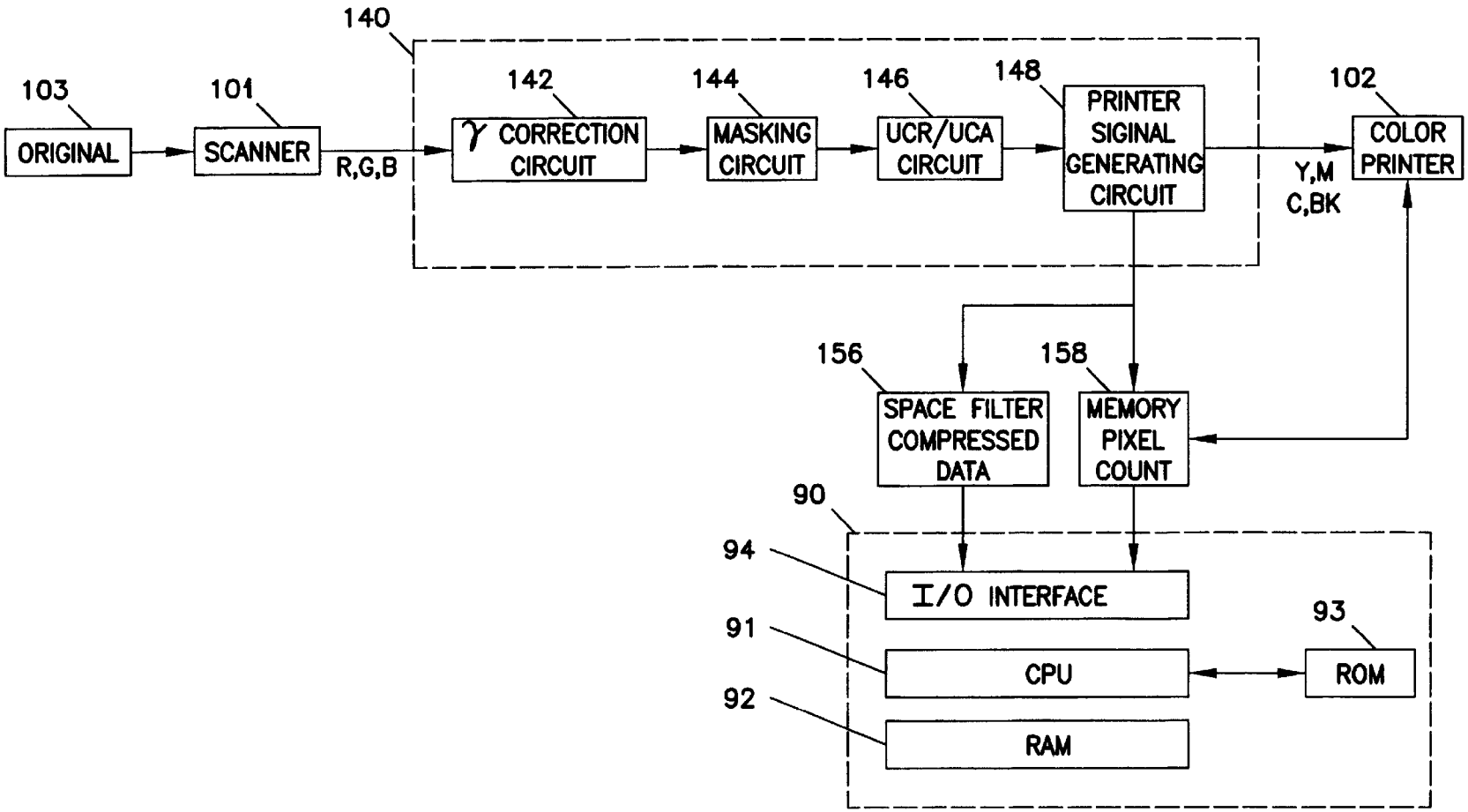
FIG. 8 is a diagram illustrating a controller for controlling a printer unit as well as an input device for inputting an image.

Referring to FIG. 8, the controller 90 is further described along with other optional components of the image reproduction system according to the current invention. The inventive concept of the controller 90 according to the current invention is generally applicable to printers, photocopiers, fax machines, and the like. An original 103 is scanned into the system by a color scanner 101, which generates Red, Green and Blue (RGB) signals. An image processing unit 140 processes the scanned RGB signals using a series of conventional circuits such as a γ correction circuit 142, a masking circuit 144, and an Under Color Removal/Under Color Addition (UCR/UCA) circuit 146. A printer signal generating circuit 148 generally generates Y, M, C and Bk signals. The color printer 102 houses an image reproduction device that is comparable to the above described photocopying engine. Although the above printer signals are directly inputted into a color printer 102 for image reproduction, the controller 90 also controls the color printer 102 based upon the same Y, M, C and Bk signals.

Still referring to FIG. 8, the controller 90 is connected to a space filter 156 for compressed data or an image memory 158 for a pixel count and further includes an I/O interface 94, a central processing unit (CPU) 91, a random access memory (RAM) 92 and a read-only memory (ROM) 93. The above described Y, M, C and Bk signals contain information on exposing the photoreceptor drum surface prior to developing. This information allows the controller to determine how much each toner is applied. The controller also has access to the data which provides information on image data that is compressed in the direction perpendicular to the moving direction of the photoreceptor drum. The pixel count provides information on the number of units to be activated for image reproduction. Based upon the above information, the CPU 91 determines optimal parameters for controlling an image reproduction engine for removing residual toner from an image forming surface. The following description on FIGS. 9–18 is related to the functions performed by the controller 90.

Figure 9B:
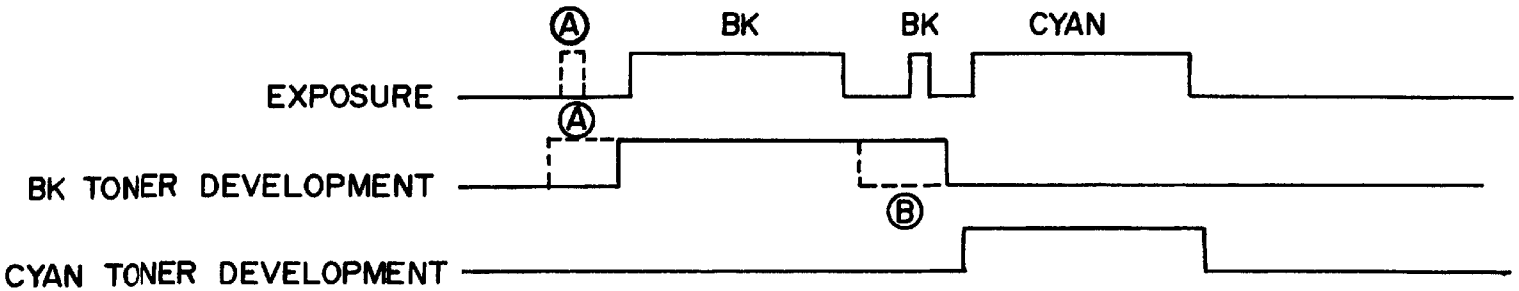
FIG. 9B is another example of a timing diagram according the current invention for image development using aspherical black toner and spherical cyan toner.
Figure 9A:
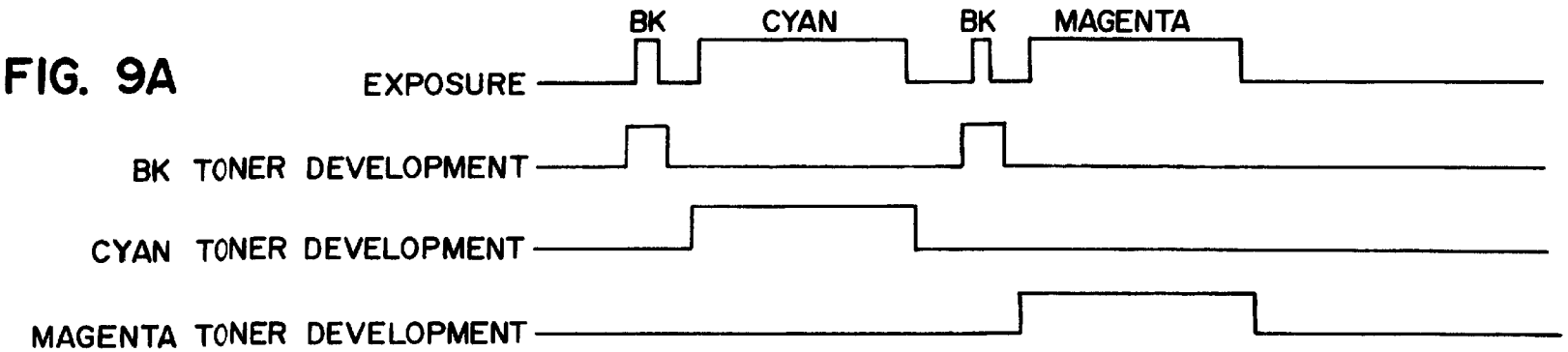
FIG. 9A is an example of a timing diagram according to the current invention for image development using spherical cyan and magenta toner in conjunction with aspherical black toner.

Referring to FIGS. 9A and 9B, timing diagrams illustrate sequences as to when each developer is activated with respect to others in an image reproduction system. The above described controller determines the activation timing of these developers based upon the information such as the Y, M, C and Bk signals. Assuming that black toner is aspherical while cyan toner and magenta toner are spherical as well as substantially smaller than the black toner. According to FIG. 9A, an image is reproduced using the cyan toner and the magenta toner. However, as described above, these ultra-fine spherical toner are effectively removed from an image forming surface if a cleaning blade is pretreated with substantially large aspherical toner. To effectively implement this feature, based upon the Y, M, C and Bk signals, the controller activates a developer containing cleaning enhancing black toner prior to each activation of a developer containing the ultra-fine spherical toner. As shown in FIG. 9A, an image forming surface of a photoreceptor drum is accordingly exposed for both black and color toner applications. In other words, the black developer is activated first, then the cyan developer is activated. Before activating the magenta developer, the black developer is again activated.

According to another timing diagram shown in FIG. 9B, an image is reproduced by using the black toner and the cyan toner. In this color scheme, the activation of portions "A" as indicated by dotted lines may be omitted since the cleaning enhancing black toner development follows these portions A. Furthermore, since the black toner has been already applied, no additional black toner application is necessary before activating the cyan developer. In other words, according to this example, since the aspherical black toner is first used to form a part of an image, the cleaning enhancing aspherical toner is necessarily delivered to a cleaning blade before the cyan toner reaches the blade. The portion B as indicated by the dotted line is an option for the black toner activation. The solid line representation is a prolonged application of the black toner to enhance the contrast between the two colors.

Figure 10:
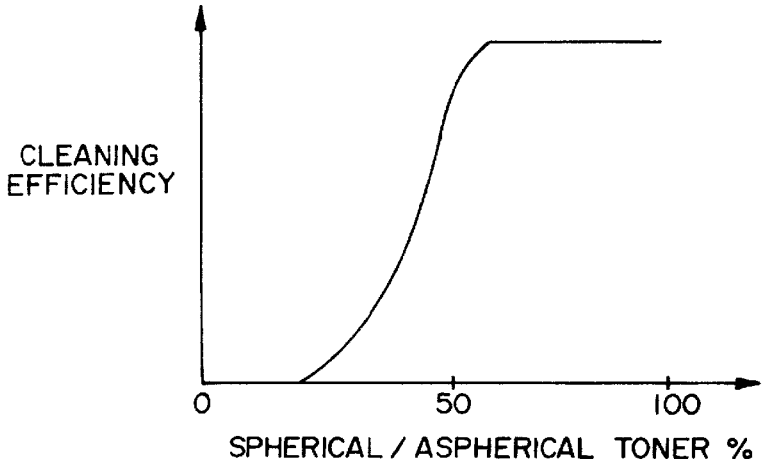
FIG. 10 is a graph depicting a relation between cleaning efficiency and a spherical/aspherical toner ratio according to the current invention.

Referring to FIG. 10, another function of the controller is to maintain an optimal cleaning efficiency by determining an appropriate amount of the above described aspherical toner to be applied to a cleaning blade with respect to an amount of a residual spherical toner to be removed. The y axis indicates relative removal of the residual toner from a photoreceptor drum while the x axis indicates the ratio in percentage of the spherical toner to the aspherical toner. For constructing FIG. 10, a particular size of the spherical toner is approximately 5 llm. while that of the aspherical toner is approximately 7.5 llm. The toner is applied to the photoreceptor at an approximate rate of 0.02 mg/cm$^2$. sec. To maintain a certain optimal level of cleaning efficiency, the above described ratio is approximately over 60% and preferably around 70%. However, the cleaning efficiency also depends on the size of the spherical toner as well as the distribution of certain size spherical toner. The cleaning efficiency is also affected by the size of the aspherical toner as well as the distribution of certain size aspherical toner. In addition, the absolute amount of the toner reaching the cleaning blade affects the above described cleaning efficiency due to a capacity of the cleaning blade.

Figure 11:
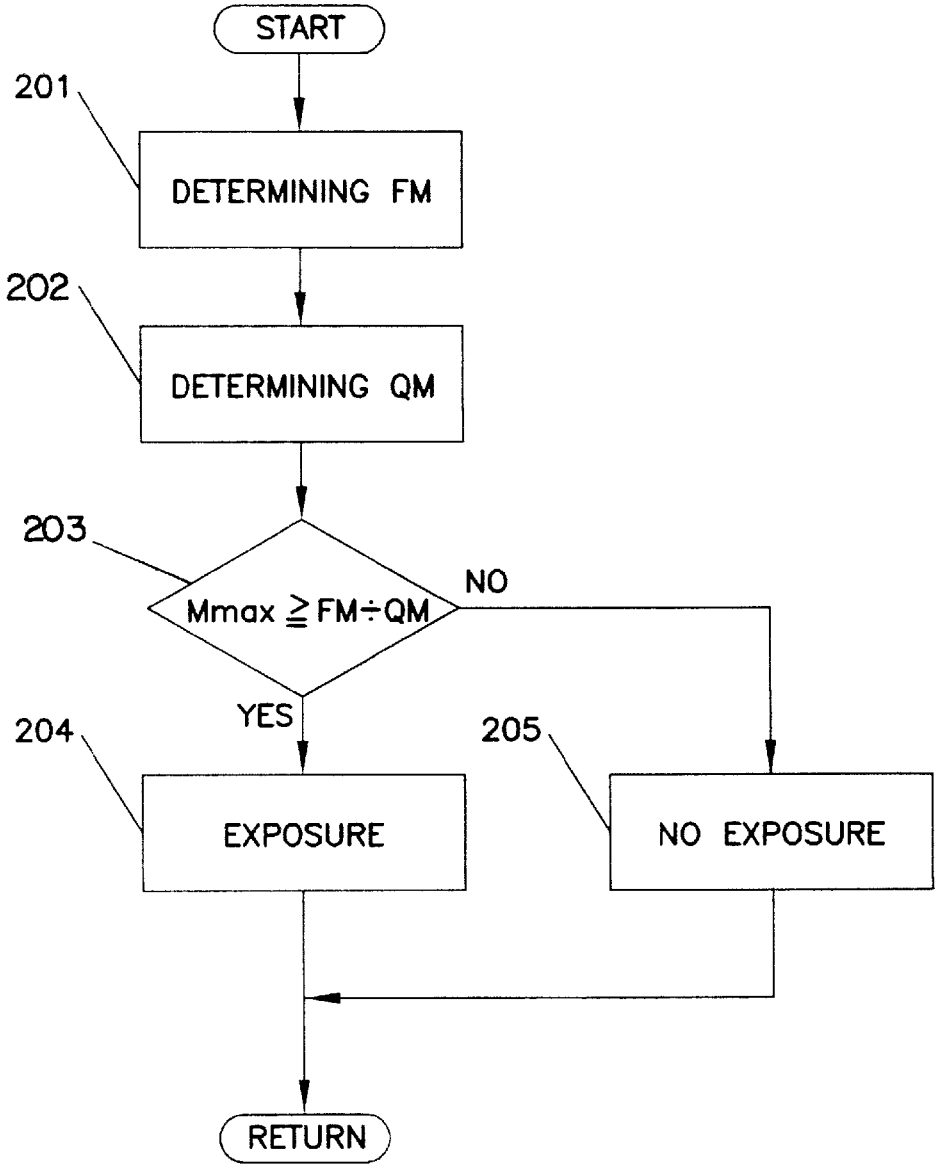
FIG. 11 is a flow chart for describing steps involved in ascertaining that a total amount of toner reaching a cleaning blade per unit time does not exceed a predetermined cleaning capability of the blade according to one aspect of the current invention.

Referring to FIG. 11, the controller ascertains that the above described absolute amount of the toner arriving at a cleaning blade does not exceed a predetermined cleaning capacity of a cleaning blade. In a step 201, an amount of the irregularly shaped toner reaching the cleaning blade (FM) is based upon a product of a total number of pixels that is represented by the aspherical toner (FG) and a predetermined coefficient K1. In the alternative, FM is based upon a product of an integral of pixels that are represented by the aspherical toner times a corresponding amount of exposure (FSD) and a predetermined coefficient K2. That is, FM=FG·K1 or FM=FSD·K2. In other words, according to one definition, FSD is defined as $$\sum_{i=0,j=0}^{i=I,j=J} G(i,j)\cdot P(i,j) \text{ where } 0 \le i \le I \text{ and } 0 \le j \le J.$$

G(i,j) indicates whether to apply the aspherical toner at a specified pixel while P(i,j) indicates the corresponding amount of exposure for the pixel to be developed by the aspherical toner. Similarly, in a step 202, an amount of the spherical toner reaching the cleaning blade (QM) is based upon a product of a total number of pixels that is represented by the spherical toner (QG) and a predetermined coefficient K3. In the alternative, QM is based upon a product of an integral of pixels that are represented by the spherical toner (QSD) times the corresponding amount of exposure and a predetermined coefficient K4. Similarly, according to one definition, QSD is defined as $$\sum_{i=0,j=0}^{i=I,j=J} H(i,j)\cdot P(i,j) \text{ where } 0 \le i \le I \text{ and } 0 \le j \le J.$$

Figure 12A:
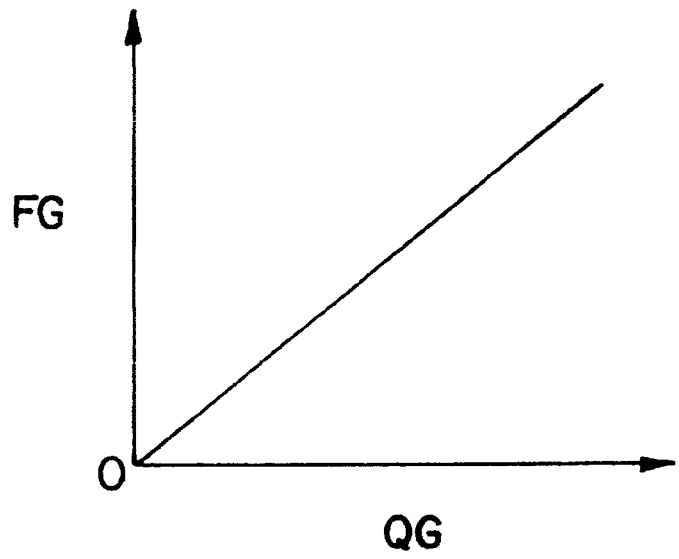
FIG. 12A is a graph depicting a relation between a total number of pixels covered by spherical toner (QG) and a total number of pixels covered by aspherical toner (FG).
Figure 12B:
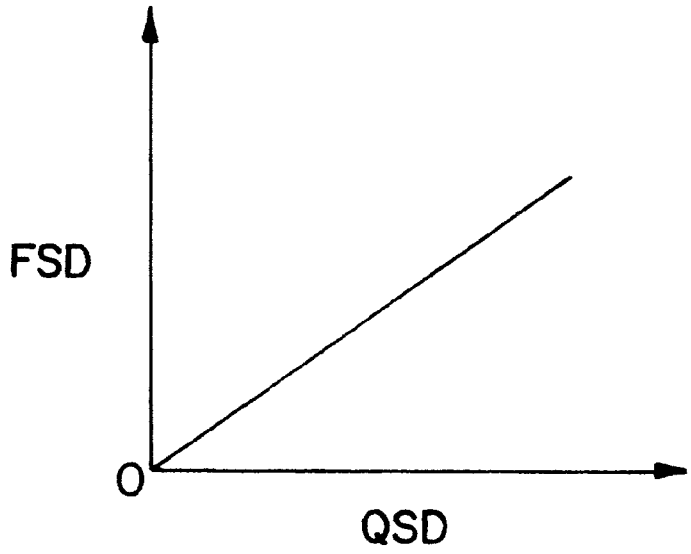
FIG. 12B is a graph depicting a relation between an integral of pixels covered by spherical toner (QSD) times the corresponding amount of exposure for each pixel and an integral of pixels covered by aspherical toner (FSD) times the corresponding amount of exposure for each pixel.

H(i,j) indicates whether to apply the spherical toner at a specified pixel while P(i,j) indicates the corresponding amount of exposure for pixel to be developed by the spherical toner. That is, QM=QG·K3 or QM=QSD·K4. In a step 203, the controller determines whether the sum of the above described FM+QM is smaller than a predetermined cleaning capacity of a cleaning blade Mmax. If the above check is "Yes", the controller proceeds with the exposure in a step 204. On the other hand, the sum exceeds the predetermined Mmax, the controller does not cause the exposure to take place. FIGS. 12A and 12B respectively illustrate a relationship between the above described FG and QG as well as between FSD and QSD. As the number of pixels represented by the spherical toner increases (FG or FSD), the amount of the aspherical toner also increases (QG or QSD). Although the FIGS. 12A and 12B both indicate an example that has a direct correlation, there are other factors that determine the above correlation. For example, a pre-cleaning condition, a speed at which a photoreceptor drum rotates during transfer, and so on all affect the above correlation. One way to summarize the above relation between FG and QG is given by an equation below.

$$FG=QG\cdot(1-T)\alpha \quad (1)$$

where T is a transfer rate of the spherical toner and $\alpha$ is a parameter which accounts for the above described additional factors for the spherical toner to arrive at a cleaning blade. Similarly, one way to summarize the above relation between FSD and QSD is given by an equation below.

$$FSD=QSD\cdot(T-1)\alpha \quad (2)$$

where T is a transfer rate of the spherical toner and $\alpha$ is a parameter which accounts for the above described additional factors for the spherical toner to arrive at a cleaning blade.

Figure 13A:
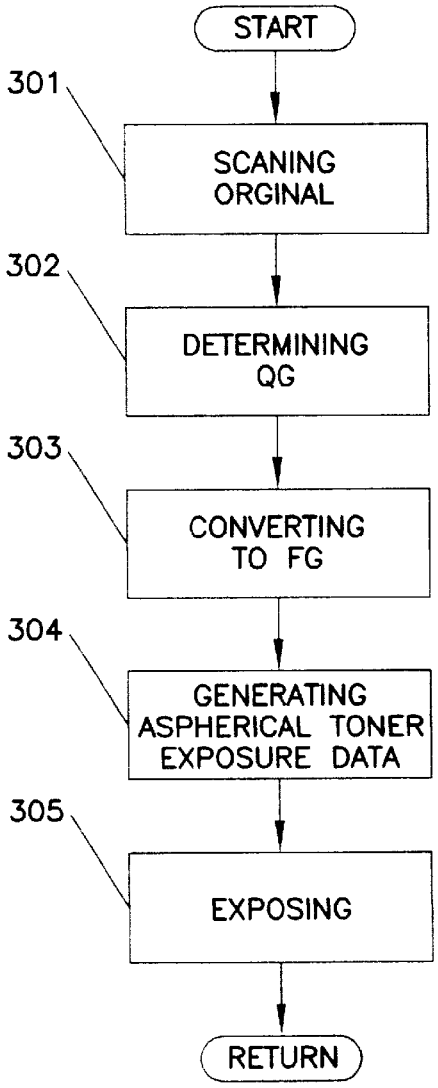
FIG. 13A is a flow chart depicting steps involved in developing an image based upon QG and FG as described with respect to FIG. 12A.
Figure 13B:
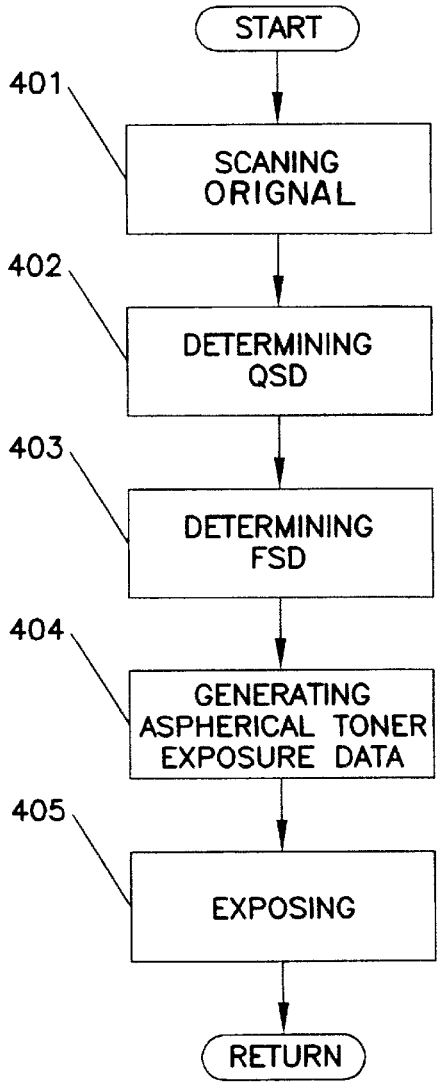
FIG. 13B is a flow chart depicting steps involved in developing an image based upon QSD and FSD as described with respect to FIG. 12B.

FIGS. 13A and 13B are flow charts respectively describing steps that the controller performs to determine an amount of exposure for the aspherical toner based upon the spherical toner. Specifically referring to FIG. 13A, in a step 301, the controller activates a scanning procedure for scanning an original. Based upon the scanned data, in a step 302, the number of pixels to be represented by the spherical toner (QG) is determined. In a step 303, the above determined value QG is converted into FG according to a predetermined equation such as the above described equation (1). The converted value is used to generate aspherical toner exposure data in a step 304, and finally, an image forming surface such as a photoreceptor drum is exposed in a step 305.

Referring to FIG. 13B, similarly, in a step 401, the controller activates a scanning procedure for scanning an original. Based upon the scanned data, in a step 402, integral data for each pixel to be represented by the spherical toner (QSD) is determined. In a step 403, the above determined value QSD is converted into FSD according to a predetermined equation such as the above described equation (2). The converted value is used to generate aspherical toner exposure data in a step 404, and finally, an image forming surface such as a photoreceptor drum is exposed in a step 405.

Figure 14A:
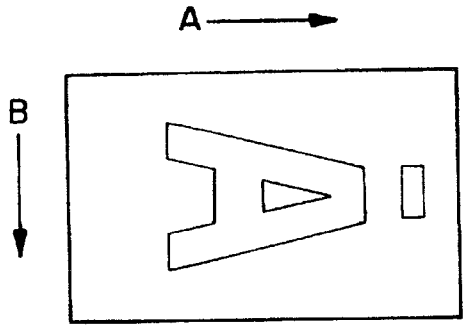
FIG. 14A illustrates an example of a desired image to be developed with directions A and B respectively indicating a main moving direction and a sub moving direction.
Figure 14B:
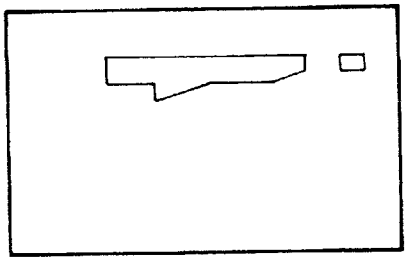
FIG. 14B illustrates image data compressed in the above described sub moving direction (the moving direction of an image forming surface) and the compressed image data is used for image development using aspherical toner according to the current invention.

FIGS. 14A and 14B illustrate an image to be developed and its corresponding compressed data used in the above processes described with respect to FIGS. 13A and 13B. FIG. 14A illustrates an example of an image of a character "A" with a bar at the top of the character. An arrow A indicates a first direction while an arrow B indicates a second direction which is perpendicular to the first direction. The second direction is the moving direction of an image forming surface. When pixel data representing the above character image is compressed in the second direction, an image corresponding to the compressed data as shown in FIG. 14B is optionally used for exposing an image forming surface for the aspherical toner. As a result of using the above described compressed data, the ratio of the spherical to aspherical toner becomes constant along the first direction.

Figure 15:
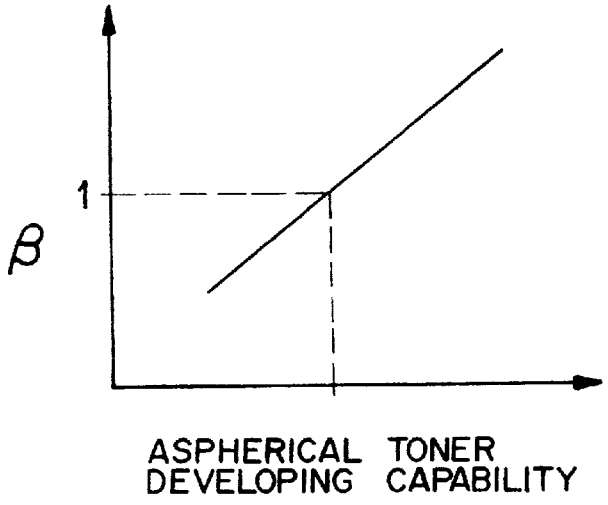
FIG. 15 is a graph depicting a relation between a β correction parameter and an aspherical toner developing capability according to the current invention.

Referring to FIG. 15, another variable for the controller to take into account includes a change in capability of an aspherical toner developer. In other words, over a course of time, a developer applies a slightly different amount of the aspherical toner to an image forming surface in response to a signal indicating the same amount of the toner application. According to one preferred embodiment of the current invention, the controller is designed to adjust the aspherical toner application. This developer capability factor for the aspherical toner may be summarized by factor β as shown in FIG. 15. To determine factor β, an amount of the applied aspherical toner is monitored by measuring the actual amount on the image forming surface. The actual amount is measured, for example, in $mg/cm^2$ with respect to applied development potential in V. The factor β is integrated in the above equations (1) and (2) as follows:

$$FG=QG\cdot(1-T)\alpha/\beta \quad (3)$$

$$FSD=QSD\cdot(T-1)\alpha/\beta \quad (4)$$

Figure 16A:
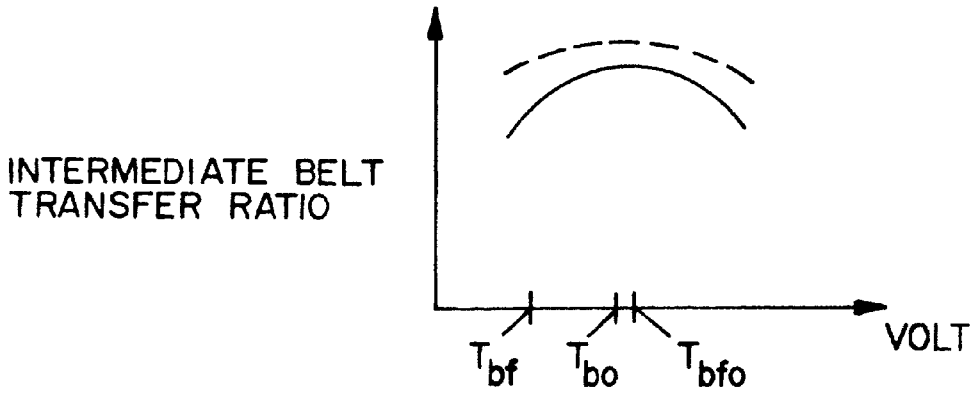
FIG. 16A is a graph depicting a relation between an intermediate belt transfer ratio and a belt transfer bias voltage for spherical as well as aspherical toner according to the current invention.
Figure 16B:
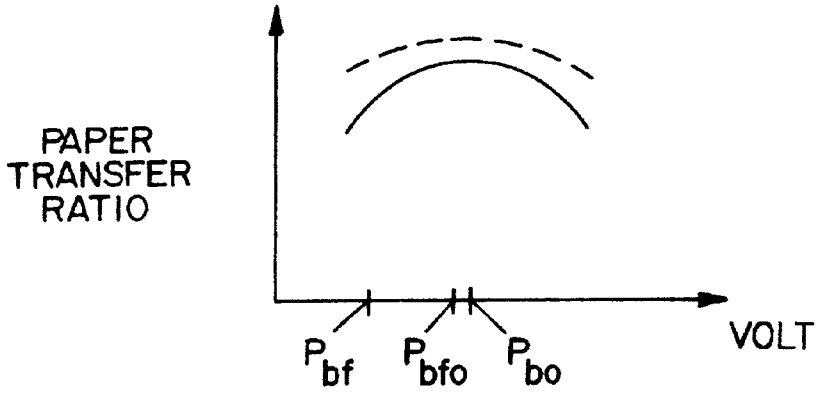
FIG. 16B is a graph depicting a relation between a paper transfer ratio and a paper transfer bias voltage for spherical as well as aspherical toner according to the current invention.

Referring to FIGS. 16A, 16B, 17 and 18, these figures are directed to describe the same invention for the above described second and third preferred embodiments as shown in FIGS. 6 and 7 that involve an intermediate transfer belt and an associated second cleaning unit. Although the same inventive concepts as described with respect to FIGS. 3–5 and 8–15 apply to the second and third preferred embodiments, certain inventive steps are slightly modified for these additional components. More specifically referring to FIGS. 16A and 16B, the differences in transfer characteristics between aspherical and spherical toner are shown. A solid line represents a transfer characteristics for aspherical toner while a dotted line represents that for spherical toner. In general, the spherical toner has a better transfer characteristics (approximately 90% to 95%) than the aspherical toner (approximately 80% to 90%). In FIGS. 16A and 16B, the x axis is in volt while the y axis is relative percentage.

Referring to FIG. 16A, a bias voltage Tb is indicated on the x axis for transferring toner from an image forming surface to an intermediate transfer belt. For the dotted line, $Tb_0$ indicates an optimal bias voltage for the spherical toner transfer to the intermediate transfer belt. For the solid line, $Tbf_0$ indicates an optimal bias voltage for the spherical toner transfer to the intermediate transfer belt. However, according to one preferred embodiment, the actually used bias voltage Tbf for the aspherical toner is set below the optimal $Tbf_0$ so that the aspherical toner that is not forming an image is intentionally left intact for the above described purposes of enhancing the removal of the residual spherical toner from the photoreceptor drum surface. For example, if the Tbf is set in such a way to transfer only 40% of the aspherical toner on the photoreceptor drum to the intermediate transfer belt, 60% of non-image-forming aspherical toner is delivered to a first cleaning blade for the purpose of removing the residual spherical toner from the photoreceptor drum. However, according to another preferred embodiments of the current invention, Tbf is optionally set equal to or above the optimal $Tbf_0$ value.

Now referring to FIG. 16B, a bias voltage Pb is indicated on the x axis for further transferring the toner from an intermediate transfer belt onto a final image-carrying medium. For the dotted line, $Pb_0$ indicates an optimal bias voltage for the spherical toner transfer onto the final image-carrying medium. For the solid line, $Pbf_0$ indicates an optimal bias voltage for the spherical toner transfer onto the final image-carrying medium. However, according to one preferred embodiment, the actually used bias voltage Pbf for the aspherical toner is set below the optimal $Pbf_0$ so that the aspherical toner that is not forming an image is intentionally left intact for the above described purposes of enhancing the removal of the residual spherical toner from the intermediate transfer belt. For example, if the Pbf is set in such a way to transfer only 40% of the aspherical toner on the intermediate transfer belt to the final image-carrying medium, 60% of non-image-forming aspherical toner is delivered to a second cleaning blade for the purpose of removing the residual spherical toner from the intermediate transfer belt. However, according to yet another preferred embodiments of the current invention, Pbf is optionally set equal to or above the optimal $Pbf_0$ value.

Figure 17:
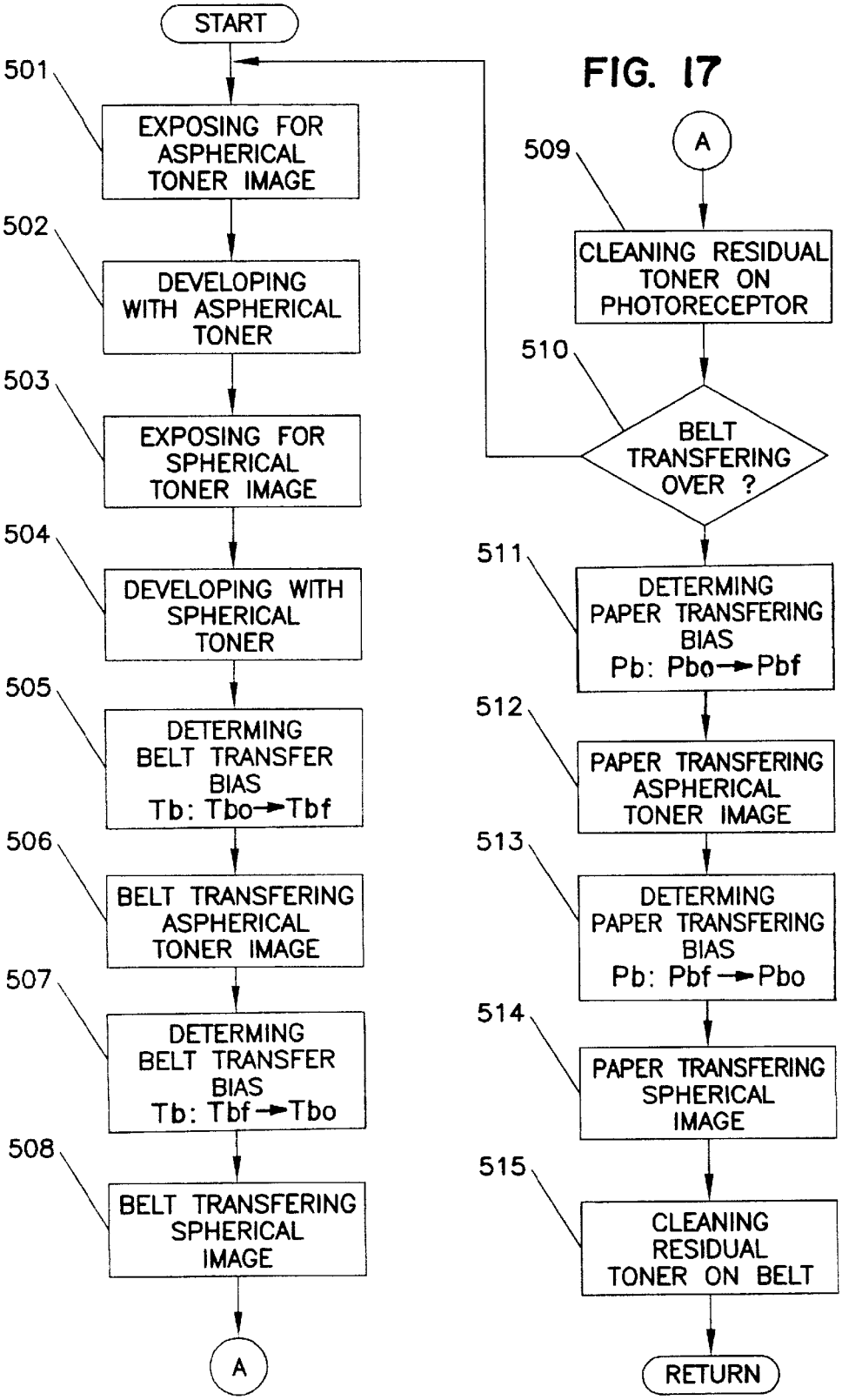
FIG. 17 is a flow chart for describing steps involved in multi-color image reproduction using spherical as well as aspherical toner via an intermediate transfer belt onto an image carrying medium while substantially removing residual spherical toner according to the current invention.

Now referring to FIG. 17, the above described controller functions are summarized in a flow chart. According to one preferred method, the controller in a step 501 controls the exposure of a photoreceptor drum surface for aspherical toner. This exposure may or may not be according to a desired image on a final image-carrying medium. If the exposed area is not a part of the final desired image, it is a separate area such as an area 23 as shown in FIG. 5. In a step 502, the above exposed area is developed with aspherical toner. According to the above described preferred embodiment, the aspherical toner is achromatic such as black. In a step 503, the controller controls the exposure of a photoreceptor drum surface for ultra-fine spherical toner, and in a step 504 the exposed area is developed with spherical toner according to a desired image. According to the above described preferred embodiment, the spherical toner is chromatic such as cyan, magenta and yellow. This completes the exposure and development steps. Still referring to FIG. 17, the toner on the photoreceptor drum is now transferred onto an intermediate transfer belt in steps 505–508. In a step 505, the controller sets the belt transfer bias to Tbf, and in a step 506, the aspherical toner on the photoreceptor drum is transferred onto the intermediate transfer belt. According to one preferred embodiment, as described with respect to FIG. 16A, Tbf is set so as to leave a sufficient amount of the cleaning enhancing aspherical toner on the photoreceptor drum. Similarly, in a step 507, the controller sets the belt transfer bias to $Tb_0$, and in a step 508, the spherical toner on the photoreceptor drum is transferred onto the intermediate transfer belt. Upon completing the above transfer to the intermediate transfer belt, residual toner remaining on the photoreceptor drum is removed in a step 509. Because of the above sequences of the transfer or, in the alternative, predetermined positions of the toner on the photoreceptor drum with respect to a first cleaning blade, the aspherical toner is delivered to an edge of the first cleaning blade prior to the removal of the residual spherical toner so that the aspherical toner effectively seals a gap between the first cleaning blade and the photoreceptor drum for substantially facilitating the departure of the residual spherical toner from the photoreceptor drum.

For multiple colors, the above described steps 501–508 are repeated as shown in a step 510. When all the necessary steps for the multiple colors are completed, the controller in a step 510 proceeds to the second transfer of the toner representing a desired image from the intermediate transfer belt to a final image-carrying medium such a sheet of paper in steps 511–515. This second transfer is also referred to as a paper transfer. In a step 511, the controller sets the paper transfer bias to Pbf, and in a step 512, the aspherical toner on the intermediate transfer belt is transferred onto the final image-carrying medium. According to one preferred embodiment, as described with respect to FIG. 16B, Pbf is set at a predetermined level which leaves a sufficient amount of the cleaning enhancing aspherical toner on the intermediate transfer belt. Similarly, in a step 513, the controller sets the paper transfer bias to $Pb_0$, and in a step 514, the spherical toner on the intermediate transfer belt is transferred onto the final image-carrying medium. Upon completing the above paper transfer to the final image-carrying medium, the controller activates a second cleaning unit so that a second cleaning blade is positioned to contact the intermediate transfer belt surface for removing residual toner on the intermediate transfer belt in a step 515. Because of the above sequences of the transfer or, in the alternative, predetermined positions of the toner on the intermediate transfer belt with respect to a second cleaning blade, the aspherical toner is delivered to an edge of the second cleaning blade prior to the removal of the residual spherical toner so that the aspherical toner effectively seals a gap between the second cleaning blade and the intermediate transfer belt for substantially facilitating the departure of the residual spherical toner from the intermediate transfer belt.

Figure 18:
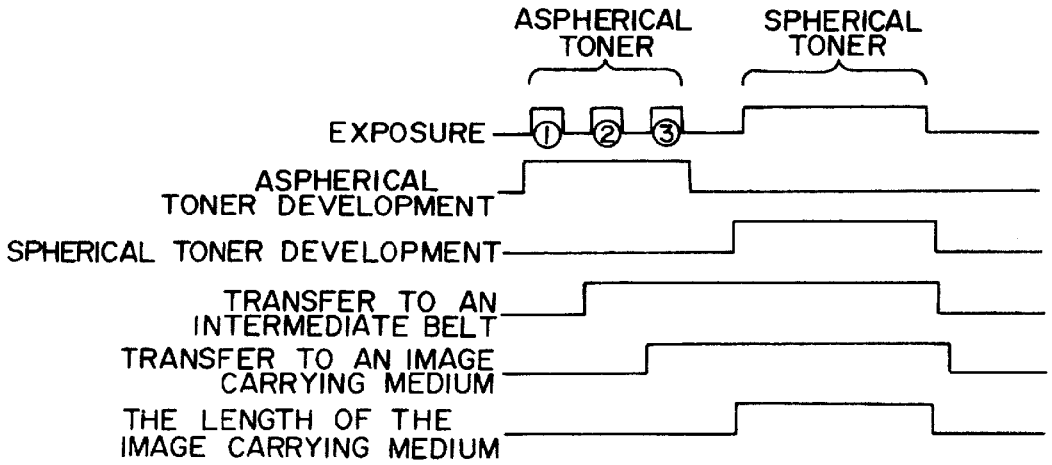
FIG. 18 is a timing diagram according to the current invention using spherical and aspherical toner for substantially removing the spherical toner from an image forming surface as well as an intermediate transfer belt after transfer.

Referring to FIG. 18, a timing diagram illustrates the activations of some overlapping sequences of the above-described steps for reproducing an image. According to one preferred embodiment of the current invention, an exposure pattern for aspherical toner is set as Nos. 1, 2 and 3 portions followed by a continuous portion for spherical toner. The aspherical toner is intended not to form a part of a final desired image. The above exposure is developed with aspherical toner first and followed with spherical toner for the corresponding exposures. At an approximate onset of the second aspherical toner development (No. 2), the transfer of the developed toner from the photoreceptor drum to an intermediate transfer belt is activated. Because of the above delayed activation, the first aspherical toner development is not transferred onto the intermediate transfer belt and remains on the photoreceptor drum surface for enhancing the removal of residual spherical toner. The transfer to the intermediate transfer belt continues throughout the spherical toner development, and the spherical toner is transferred onto the intermediate transfer belt as it is developed. After the No. 2 aspherical toner and at an approximate onset of the third aspherical toner development (No. 3), the transfer to a final image-carrying medium such as a sheet of paper is activated. Because of this activation timing, the No. 2 aspherical toner remains on the intermediate transfer belt for enhancing the removal of residual spherical toner. Lastly, the length of the final image-carrying medium or the timing of the available paper surface is indicated with respect to the above described second transfer. Because this timing coincides with that of the spherical toner development, only the spherical toner which is developed for a final desired image is transferred onto the final image-carrying medium.

Still referring to FIG. 18, because of the above described onset of each transfer, aspherical toner arrives at a cleaning unit prior to the removal of the residual spherical toner removal. In this regard, an intact portion of No. 1 along with the residual portions of Nos. 2 and 3 aspherical toner remaining after the transfer arrives at a first cleaning blade prior to the residual spherical toner on the photoreceptor drum. By the same token, a portion of No. 2 transferred onto an intermediate transfer belt along with a residual portion of No. 3 after transfer to a final image-carrying medium arrives at a second cleaning blade prior to the residual spherical toner on the intermediate transfer belt. The amount of the aspherical toner to be delivered to each of the cleaning blades is adjusted by varying parameters such as a transfer bias voltage, a size of the aspherical toner portions, a transfer rate of the aspherical toner, and so on.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts and in the applications such as printers, fax machines and photocopiers, within the principles of the invention to the full extent indicated by the broad general meaning of the terms in which the appended claims are expressed.

What is claimed is:

1. A method of cleaning toner on a surface of an image forming device after development by a cleaning blade, the toner including first toner and second toner, comprising the steps of:

a) developing an image according to the toner including at least the first toner placed on a first area of a surface of the image forming device;

b) transferring the toner in the first area to an image carrying medium;

c) placing the second toner on the cleaning blade which contacts the surface of the image forming device; and d) removing the first toner remained on the surface after said step b) by the cleaning blade treated with the second toner in said step c), wherein the second toner provides a substantially effective seal between the surface of the image forming device and the cleaning blade so as to facilitate the first toner to depart from the surface of the image forming device.

2. The method of cleaning toner according to claim 1 wherein the first toner is substantially spherical.

3. The method of cleaning toner according to claim 2 wherein the first toner is smaller than approximately 7 $\mu$m in diameter.

4. The method of cleaning toner according to claim 2 wherein the second toner is substantially aspherical.

5. The method of cleaning toner according to claim 4 wherein the second toner is larger than approximately 7 $\mu$m in diameter.

6. The method of cleaning toner according to claim 4 wherein the toner used in said step a) is a mixture of the first toner and the second toner.

7. The method of cleaning toner according to claim 6 wherein said step c) is performed by removing the second toner from the surface with the cleaning blade.

8. The method of cleaning toner according to claim 1 wherein an amount of the second toner to be applied to the cleaning blade in said step c) is determined based upon a predetermined characteristics of the first toner placed on the surface of the image forming device in said step a).

9. The method of cleaning toner according to claim 8 wherein the predetermined characteristics includes an amount of the first toner placed on the surface, a number of pixels covered by the first toner, an amount of light used for exposing for the first toner, a compressed data representing the first toner distribution, and a developing condition.

10. The method of cleaning toner according to claim 9 wherein a total amount of the first toner remained on the surface and the second toner placed on the cleaning blade is less than a predetermined cleaning capacity of the cleansing blade.

11. The method of cleaning toner according to claim 1 further comprising an additional step of brushing the toner off the surface of the image forming device prior to said step d).

12. The method of cleaning toner according to claim 1 wherein the first toner is spherical and in multiple colors including cyan, magenta, yellow and the second toner is aspherical and black.

13. The method of cleaning toner according to claim 12 wherein said steps a) through d) are repeated for each of the multiple colors.

14. The method of cleaning toner according to claim 12 wherein said steps a) and b) are repeated for each of the multiple colors prior to said steps c) and d).

15. The method of cleaning toner according to claim 12 wherein the black toner is applied to the first area of the surface to form a part of the image.

16. The method of cleaning toner according to claim 12 wherein the black toner is applied to a second area of the surface outside of the first area.

17. The method of cleaning toner according to claim 16 wherein said step c) is performed by removing the black toner with the cleaning blade before any of the multiple color toners reaches the cleaning blade.

18. The method of cleaning toner according to claim 17 wherein the surface is rotated towards the cleaning blade.

19. A method of cleaning toner on a surface of an image forming device after development by a cleaning blade, the toner including first toner and second toner, comprising the steps of:

a) placing the first toner according to a desired image in a first area on the surface of the image forming device, the first toner being substantially spherical;

b) placing the second toner in a second area outside of the first area on the surface of the image forming device, the second toner being substantially aspherical;

c) transferring a substantial portion of the first toner in the first area to an image carrying medium and leaving a residual portion of the first toner on the surface;

d) transporting the second toner to the cleaning blade before the residual portion of the first toner reaches the cleaning blade; and e) removing the residual portion of the first toner from the surface by the cleaning blade treated with the second toner, wherein the second toner provides a substantially effective seal between the surface of the image forming device and the cleaning blade so as to facilitate the first toner to depart from the surface of the image forming device.

20. The method of cleaning toner according to claim 19 wherein the first toner is smaller than approximately 7 $\mu$m in diameter.

21. The method of cleaning toner according to claim 20 wherein the second toner is larger than approximately 7 $\mu$m in diameter.

22. A system for cleaning residual toner, comprising:

a first container for containing first toner;

a second container for containing second toner;

an image forming surface located near said first container and said second container for developing a desired image with at least the first toner placed on said image forming surface;

a cleaning blade selectively in contact with said image forming surface for removing the first toner from said image forming surface, said image forming surface and said cleaning blade in contact having a minute gap through which the first toner passes; and a cleaning enhancer for applying the second toner to said cleaning blade so as to substantially facilitate a removal of the first toner from said image forming surface, wherein the second toner substantially seals the minute gap between said image forming surface and said cleaning blade so that said cleaning blade more effectively removes the first toner from the image forming surface.

23. The system for cleaning residual toner according to claim 22 wherein the first toner is substantially spherical.

24. The system for cleaning residual toner according to claim 23 wherein the second toner is substantially aspherical.

25. The system for cleaning residual toner according to claim 24 wherein the second toner is larger than approximately 7 $\mu$m in diameter.

26. The system for cleaning residual toner according to claim 22 wherein the first toner is smaller than approximately 7 $\mu$m in diameter.

27. The system for cleaning residual toner according to claim 22 further comprising a controller for determining an amount of the second toner to be applied by said cleaning enhancer to the cleaning blade based upon a predetermined characteristics of the first toner placed on said image forming surface.

28. The system for cleaning residual toner according to claim 27 wherein the predetermined characteristics includes an amount of the first toner placed on the surface, a number of pixels covered by the first toner, an amount of light used for exposing for the first toner, a compressed data representing the first toner distribution, and a developing condition.

29. The system for cleaning residual toner according to claim 27 wherein a total amount of the first toner remained on the surface and the second toner placed on the cleaning blade is less than a predetermined cleaning capacity of said cleaning blade.

30. The system for cleaning residual toner according to claim 22 further comprising a toner removing brush selectively in contact with said image forming surface for removing the first toner from said image developing surface.

31. The system for cleaning residual toner according to claim 22 wherein the first toner is spherical and in multiple colors including cyan, magenta, yellow and the second toner is aspherical and black.

32. The system for cleaning residual toner according to claim 31 wherein said image forming surface has a first area, the black toner being applied to the first area to form a part of the desired image.

33. The system for cleaning residual toner according to claim 32 wherein said image forming surface has a second area outside of the first area, the black toner is applied to the second area.

34. The system for cleaning residual toner according to claim 33 wherein said cleaning enhancer applies the black toner to said cleaning blade before any of the multiple color toners reaches the cleaning blade.

35. The system for cleaning residual toner according to claim 34 further comprises a driving motor for rotating said image forming surface towards said cleaning blade.

36. The system for cleaning residual toner according to claim 22 wherein said first container further comprises a separate toner subcompartment for containing each of the multiple colors.

37. The system for cleaning residual toner according to claim 36 wherein said image forming surface develops each of the multiple colors at a time and said cleaning blade also removes each of the multiple colors from said image forming surface.

38. The system for cleaning residual toner according to claim 36 wherein said image forming surface develops all of the multiple colors before said cleaning blade removes the multiple colors at the same time from said image forming surface.

39. A system for cleaning residual toner, comprising:

a first container for containing substantially spherical toner defining first toner;

a second container for containing substantially aspherical toner defining second toner, the second toner being larger than the first toner;

an image forming surface located near said first container and said second container for developing an image according to at least the first toner placed on said image forming surface;

a cleaning blade selectively in contact with said image forming surface for removing the first toner from said image forming surface, said image forming surface and said cleaning blade in contact having a minute gap through which the first toner passes; and a second toner applicator for applying the second toner to said cleaning blade so as to facilitate a removal of the first toner from said image forming surface, the second toner provides a substantially effective seal for the minute gap between said image forming surface and said cleaning blade so as to prevent the first toner from passing through the minute gap.

* * * * *